US006161647A

United States Patent [19]

Braden et al.

[11] Patent Number: 6,161,647

[45] Date of Patent: Dec. 19, 2000

[54] FALL ARRESTING LADDER SAFETY DEVICE

[75] Inventors: J. Michael Braden, Mars; James P. Evans, Warren; Emory E. Edmiston, Tiona; David A. Jenkins, Warren, all of Pa.

[73] Assignee: Pitt-Des Moines, Inc., The Woodlands, Tex.

[21] Appl. No.: 09/236,705

[22] Filed: Jan. 25, 1999

[51] Int. Cl.[7] ..... A47L 3/04

[52] U.S. Cl. ..... 182/8; 182/5

[58] Field of Search ..... 182/3, 8, 9, 36, 182/133, 134, 135, 136, 191, 192, 193, 235, 5; 188/65.2, 65.3

[56] References Cited

U.S. PATENT DOCUMENTS

| | | | |
|---|---|---|---|
| 1,022,417 | 4/1912 | Heydlauff | 182/192 |
| 2,616,609 | 11/1952 | Herod | 182/8 |
| 3,348,632 | 10/1967 | Swager | 182/8 X |
| 3,523,591 | 8/1970 | Fountain | 182/8 |
| 3,876,036 | 4/1975 | Sweet . | |
| 3,885,647 | 5/1975 | Acosta | 1812/8 |
| 3,926,278 | 12/1975 | Molnar et al. | 182/192 X |
| 3,948,362 | 4/1976 | Greest . | |
| 3,968,858 | 7/1976 | Vollan et al. | 182/135 |
| 3,979,797 | 9/1976 | Stember . | |
| 4,071,926 | 2/1978 | Sweet et al. . | |
| 4,085,818 | 4/1978 | Swager | 182/8 X |
| 4,130,177 | 12/1978 | Pandolph | 182/8 |
| 4,193,475 | 3/1980 | Sweet et al. . | |
| 4,253,693 | 3/1981 | Gish . | |
| 4,269,284 | 5/1981 | Swager | 182/8 |
| 4,352,409 | 10/1982 | Fountain . | |
| 4,392,555 | 7/1983 | Ellis . | |
| 4,502,668 | 3/1985 | Dodge, Jr. . | |
| 4,542,884 | 9/1985 | Dodge, Jr. . | |
| 4,560,029 | 12/1985 | Dalmaso . | |
| 4,595,174 | 6/1986 | Dodge, Jr. et al. . | |
| 4,632,218 | 12/1986 | Hannan et al. . | |
| 4,632,226 | 12/1986 | Koch . | |
| 4,657,110 | 4/1987 | Wolner . | |
| 4,702,347 | 10/1987 | Nilsen | 182/8 |

(List continued on next page.)

FOREIGN PATENT DOCUMENTS

| | | | |
|---|---|---|---|
| 1473300 | 3/1967 | France | 182/8 |
| 2626425 | 12/1977 | Germany | 182/8 |
| 163705 | 8/1933 | Switzerland | 182/8 |

OTHER PUBLICATIONS

Siebe North Inc.; SAF–T–CLIMB®fall prevention system; 1997; manual; North Safety Products, Brea, California 92821—23 pages.

D B Industries, Inc.; DBI/SALA; 1993—3 pages.

*Primary Examiner*—Daniel P. Stodola
*Assistant Examiner*—Curtis A. Cohen
*Attorney, Agent, or Firm*—Henderson & Sturm LLP

[57] ABSTRACT

A fall arresting ladder safety device for attachment to a fixed ladder side rail. The fall arresting device is to be used in conjunction with a body harness worn by the climber with a lanyard attached at one end to the body harness and the other end attached to the fall arresting device. The fall arresting device includes first and second arms pivotally connected in an X-configuration with each arm having first and second ladder side rail engaging portions disposed on opposite edges of the ladder side rail. A spring operably attached to the first and second arms biases the first and second arms between a fall arresting position and a climbing position. To ascend or descend the ladder, the handle portion of the first arm is pivoted upward to disengage the ladder side rail engaging portions of the first arm so that the device can be rolled up or down the ladder side rail as the climber ascends or descends the ladder. The arms of the fall arresting device can be locked into a disengaging position such that the fall arresting device can be removed from the ladder side rail and carried by the climber for later use when descending the ladder or ascending another ladder.

19 Claims, 6 Drawing Sheets

U.S. PATENT DOCUMENTS 4,767,091 8/1988 Cuny ..... 182/3 X
5,146,655 9/1992 Gibbs .
5,265,696 11/1993 Casebolt .
5,279,385 1/1994 Riches et al. .
5,316,103 5/1994 Bell et al. .
5,343,975 9/1994 Riches et al. .
5,638,919 6/1997 Pejout .
5,664,640 9/1997 Smith .
5,863,020 1/1999 Olson et al. ..... 182/3 X

FALL ARRESTING LADDER SAFETY DEVICE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to fall arresting ladder safety devices, and more particularly to fall arresting ladder safety devices that attach to a ladder side rail rather than a rigid carrier rail or carrier cable extending along the centerline of the ladder.

2. Description of the Related Art

As required by the Occupational Safety and Health Administration (OSHA) regulations (29 C.F.R. §1926.1053 (a)(19)), all fixed ladders that have a length of climb equal to or exceeding 24 feet (7.3 meters) must be equipped with fall arresting ladder safety devices, or self-retracting lifelines, or a ladder cage. Additionally, where the length of climb exceeds 50 feet (15.2 meters), rest platforms or offset landings must be provided on the ladders.

Conventional fall arresting ladder safety systems, such as those sold under the trademarks Saf-T-Climb®, a registered trademark of Siebe North Inc., and Lad-Saf®, a registered trademark of D B Industries, Inc., include a carrier device which is attached to a rigid carrier rail or a carrier cable for movement therealong. The carrier rail or cable extends vertically along the length of the ladder and is disposed a distance outward from the ladder rungs along the centerline thereof. A lanyard, typically six feet (1.8 meters) in length is connected at one end to the carrier device with the other end connected to the body harness of the climber. As the climber ascends or descends the ladder, the carrier device is pulled along the carrier rail or cable with the climber. If the climber loses his or her footing, or for some other reason falls from the ladder, the carrier device lockably engages the rigid carrier rail or cable such that the climber will only free fall the distance of the length of the lanyard. Thus, the climber's free fall is arrested after only a short distance.

However, there are a number of disadvantages to the rail or cable type systems. For climbers who must utilize such devices, the main disadvantage is inconvenience. On the rail or cable type system, the carrier device is dragged up and down the carrier rail or cable behind the climber and often binds up, requiring the climber to stop his or her ascent or descent to unbind the carrier. Such binding of the carrier is an annoyance and inconvenience to the climbers.

Another disadvantage to such systems is that the climber must straddle the carrier rail or cable with one hand and one foot on each side of the carrier rail or cable as he or she climbs the ladder. This is also an annoyance to the climber who would much rather have an unobstructed ladder rung on which to place his or her hands and feet during climbing or working off of the ladder.

Yet another disadvantage of the rail or cable type systems is that each fixed ladder must be specially equipped with the special carrier rail or cable and one or more carrier devices. Equipping ladders with these special carrier rails or cables and carrier devices can be quite expensive, especially if the site or facility on which the system is installed is greater than 50 feet in height requiring a series of offset ladders and landings or rest platforms.

Thus, those concerned with these and other problems recognize the need for an improved fall arresting ladder safety device.

BRIEF SUMMARY OF THE INVENTION

A fall arresting ladder safety device for attachment to a fixed ladder side rail. The fall arresting device is to be used in conjunction with a body harness worn by the climber with a lanyard attached at one end to the body harness and the other end attached to the fall arresting device. The fall arresting device includes first and second arms pivotally connected in an X-configuration with each arm having first and second ladder side rail engaging portions disposed on opposite edges of the ladder side rail. A spring operably attached to the first and second arms biases the first and second arms between a fall arresting position and a climbing position, with the arms being normally biased in the fall arresting position wherein the first and second ladder side rail engaging portions of both first and second arms are lockably engaging the ladder side rail. The side rail engaging portions of the first arm are preferably U-shaped channel members with roughened grips that lockably engage the ladder side rail, while the side rail engaging portions of the second arm are preferably rollers that allow the device to roll up and down the ladder side rail. To ascend or descend the ladder, the climber keeps one hand on the handle portion of the first arm with the other hand grasping the ladder rungs or opposite side rail. To move the device, the climber pivots the handle portion of the first arm upward to disengage the roughened grips of the U-shaped channel member side rail engaging portions of the first arm, thereby leaving only the rollers of the side rail engaging portions of the second arm engaging the ladder side rail. The device is then rolled up or down ahead of the climber as the climber ascends or descends the ladder. The arms of the fall arresting device can be locked into a disengaging position such that said fall arresting device can be removed from the ladder side rail for later use on the same or another ladder.

Other objects, advantages, and novel features of the present invention will become apparent from the following detailed description of the invention when considered in conjunction with the accompanying drawings.

DETAILED DESCRIPTION OF THE INVENTION

Figure 1:
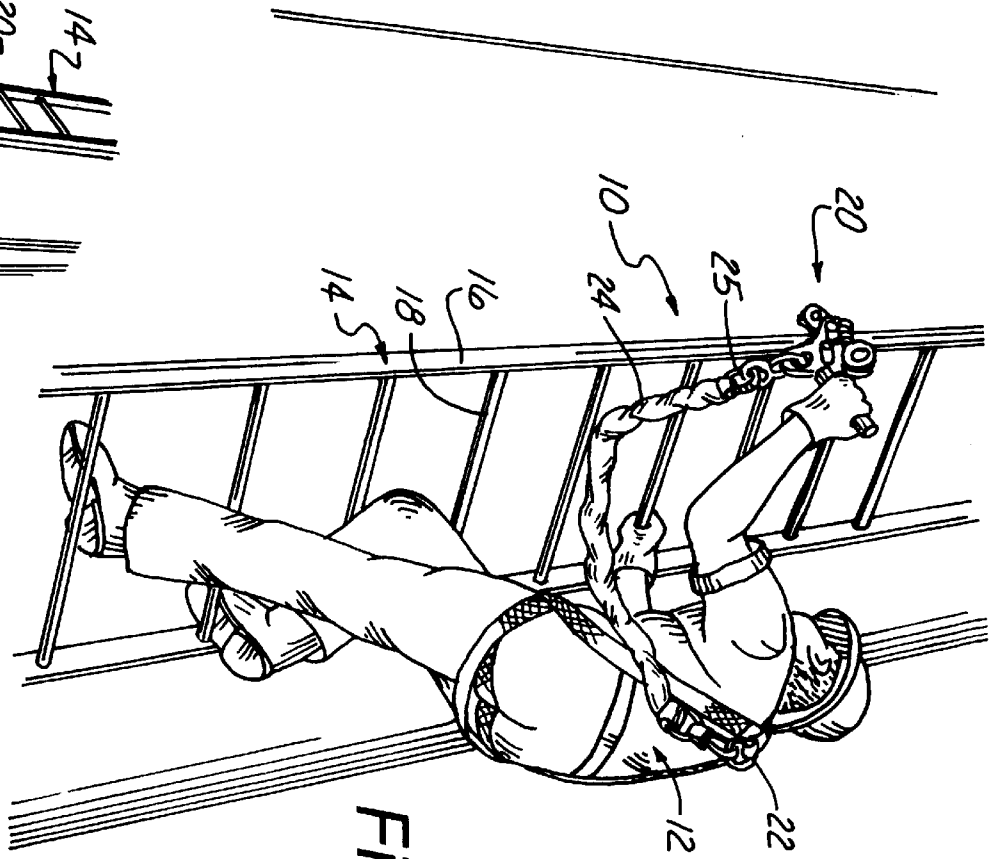
FIG. 1 is a perspective view showing the preferred embodiment of the fall arresting device of the present invention attached to a side rail of a ladder and being used by a climber.

Referring now to the drawings, wherein like reference numerals designate identical or corresponding parts throughout the several views, FIG. 1 shows a ladder safety system (10) being used by a climber (12) climbing a ladder (14) having side rails (16) and rungs (18).

The ladder safety system (10) of the preferred embodiment is comprised of a fall arresting device (20), a body harness (22), and a lanyard (24). The fall arresting device (20) removably attaches to the side rail (16) of the ladder (14). The lanyard (24), comprising a rope or chord having quick release clips (25) at each end, removably attaches at one end to the fall arresting device (20) and at the other end to the body harness (22) worn by the climber (12). It should be understood that any reference to the body harness (22) is intended to include any type of body restraint worn by a climber (12) for attachment to a lanyard (24) that serves to support the body of the climber (12) from the lanyard (24) in case of a fall.

Figure 2:
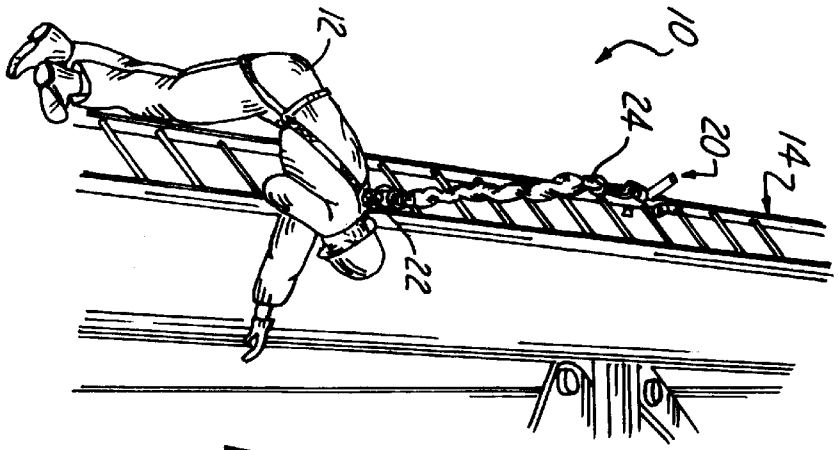
FIG. 2 is a perspective view showing the fall arresting device of the present invention supporting a climber that has fallen from the ladder.

FIG. 2 shows the fall arresting device (20) of the present invention supporting the climber (12) from the lanyard (24) after falling from the ladder (14). The fall arresting device (20) is lockably engaged on the ladder side rail (16) in the fall arresting position (discussed later).

Figure 3:
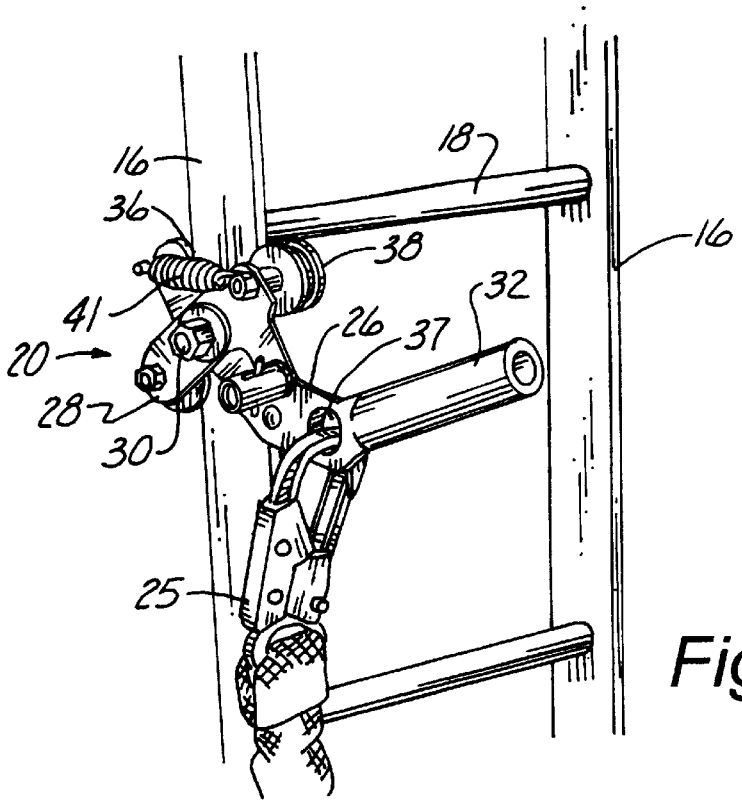
FIG. 3 is a forward perspective view of the preferred embodiment of the fall arresting device of the present invention attached to a ladder side rail.
Figure 4:
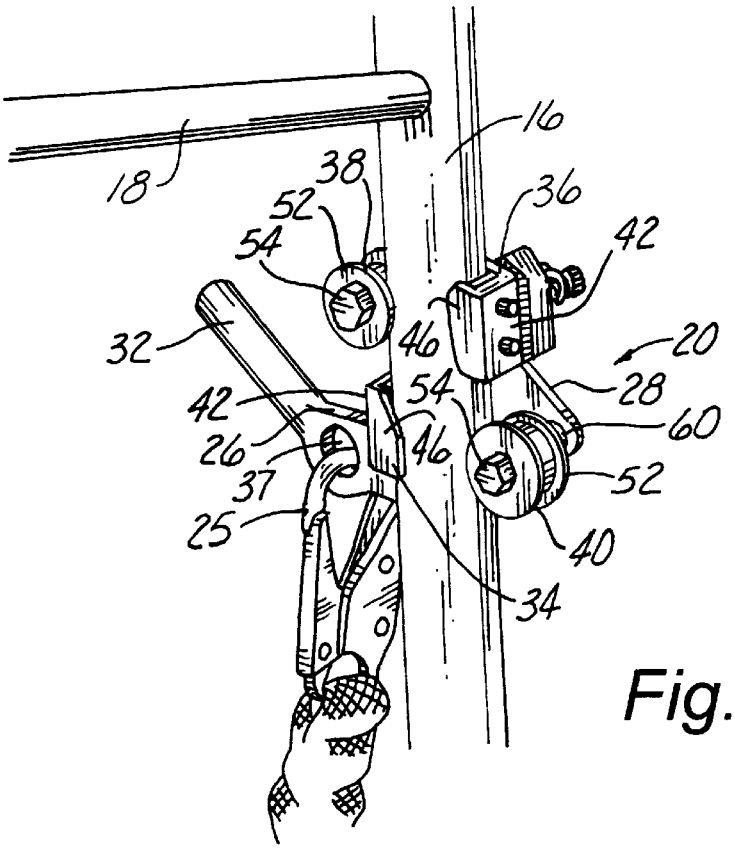
FIG. 4 is a rearward perspective view of the preferred embodiment of the fall arresting device of the present invention attached to a ladder side rail.
Figure 5:
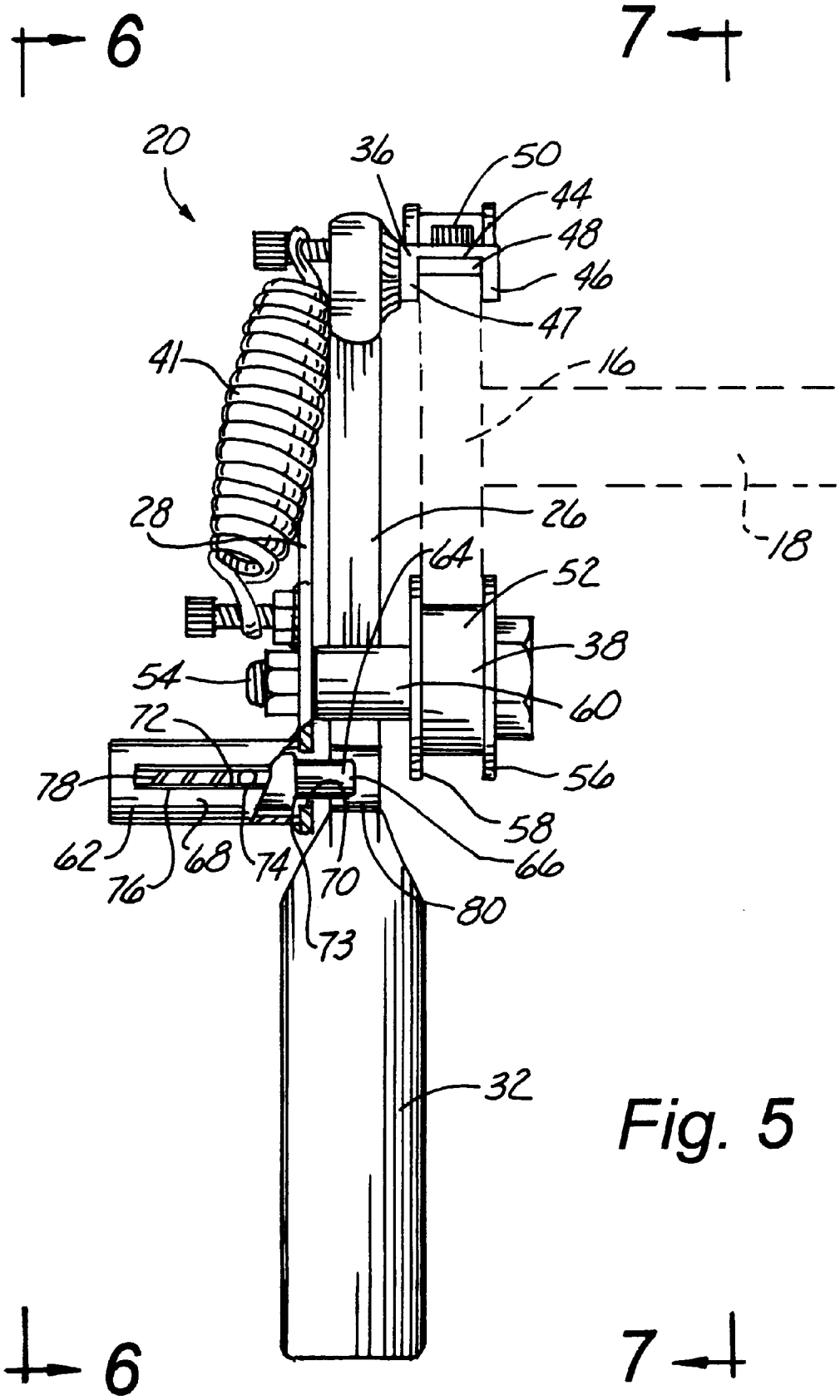
FIG. 5 is a top plan view of the of the preferred embodiment of the fall arresting device of the present invention attached to a ladder side rail.
Figure 6:
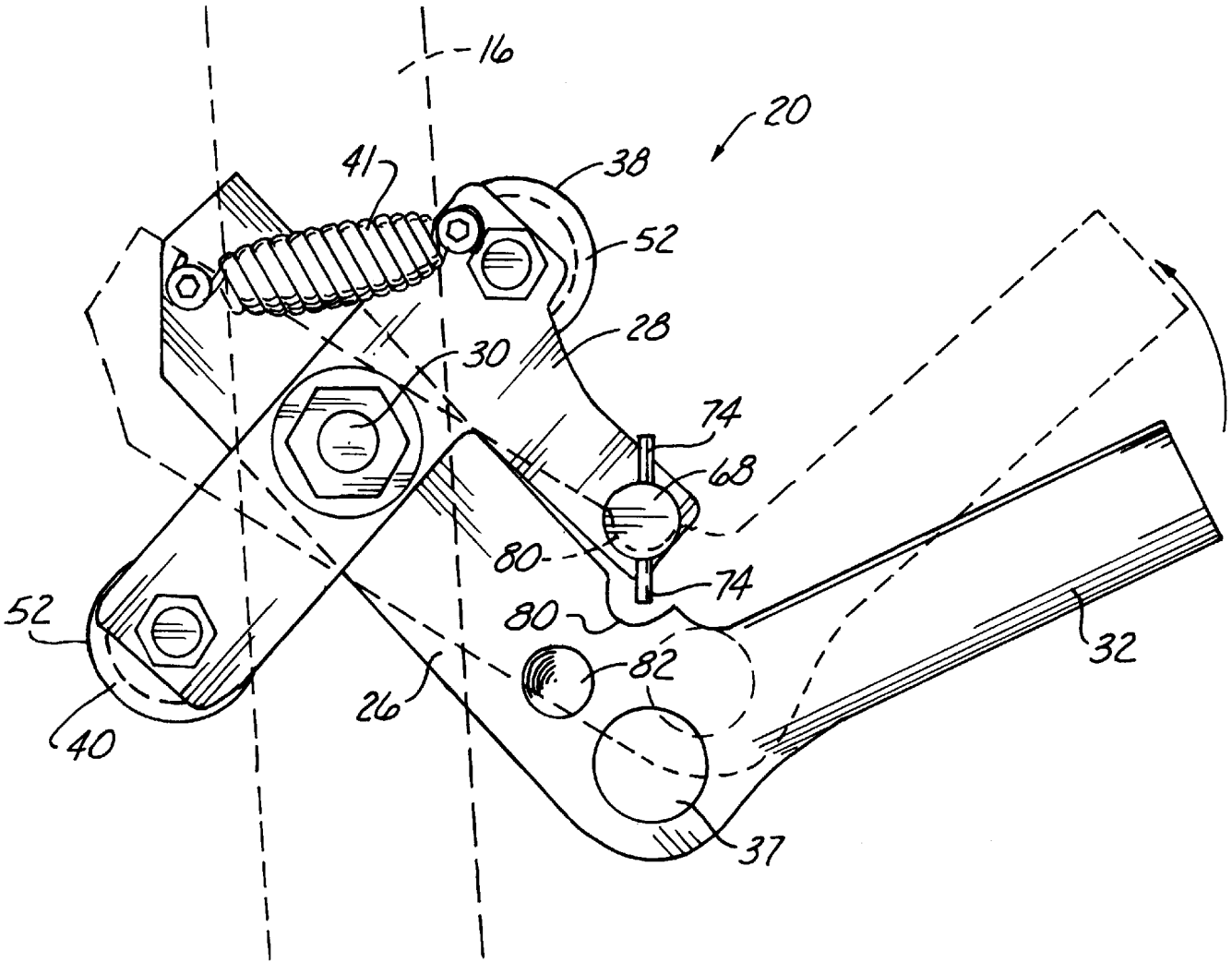
FIG. 6 is a left side elevation view of the preferred embodiment of the fall arresting device of the present invention attached to a ladder side rail and showing the movement of the device between a first fall arresting position (solid lines) and a second climbing position (dashed lines)
Figure 7:
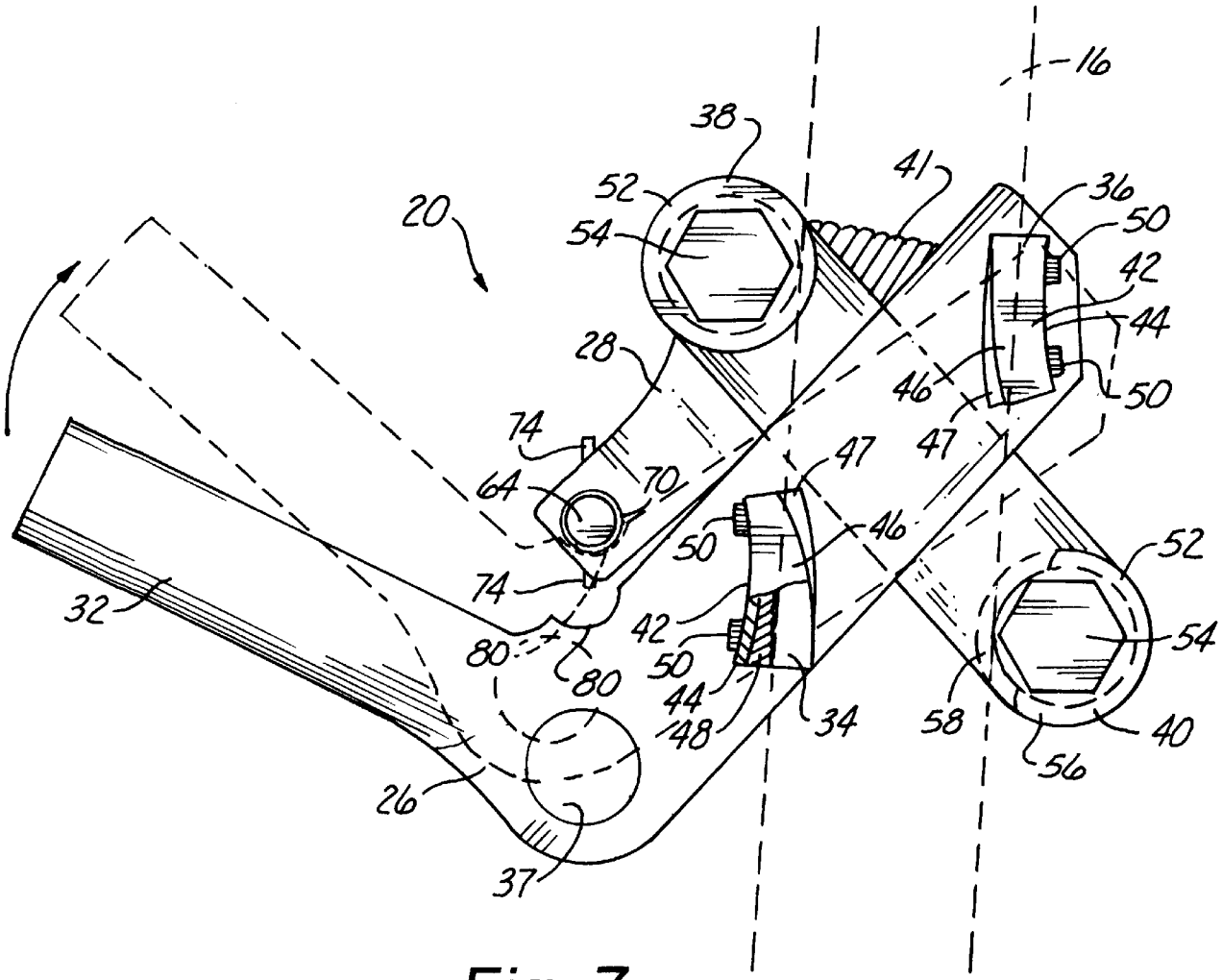
FIG. 7 is a right side elevation view of the preferred embodiment of the fall arresting device of the present invention attached to a ladder side rail and showing the movement of the device between a first fall arresting position (solid lines) and a second climbing position (dashed lines)

The preferred embodiment of the fall arresting device (20) includes first and second arms (26, 28) (FIGS. 3–8) that are pivotally attached to one another in an "X" configuration by a pin (30) (best viewed in FIG. 6) such that each arm (26, 28) is pivotal with respect to the other about the axis of the pin (30) much like the action of a scissors. The first arm (26) includes a dog-legged handle portion (32) and first and second ladder side rail engaging portions (34, 36) (FIGS. 5, 7). The second arm (28) also includes first and second ladder side rail engaging portions (38, 40) (FIGS. 5, 7). An aperture (37) (FIGS. 3, 4) is disposed in the first arm (26) near the handle portion (32) for receiving the quick release clip (25) of the lanyard (24).

To comply with the strength and force tests required by OSHA regulations (29 C.F.R. § 1926.502(d) and the accompanying recommended guidelines of §1926 Subpart M, Appendix C), it has been determined that the first arm (26) is preferably fabricated from ⅜ inch steel plate. The second arm (28) is preferably fabricated from 12 gauge or ⅛ inch steel plate.

When the fall arresting device (20) is attached to the ladder side rail (16), due to the "X" configuration, each of the ladder side rail engaging portions (34, 36) of the first arm (26) and the side rail engaging portions (38, 40) of the second arm (28) are disposed on opposite edges of the ladder side rail (16). A coil spring (41) (FIGS. 3, 5, 6), or any other type of biasing means, such as an arm spring, an elastomeric band, or the like, is operably attached to the first and second arms (26, 28), such that the ladder side rail engaging portions (34, 36) of the first arm (26) and the ladder side rail engaging portions (38, 40) of the second arm (28) are pivotally biased and engaged against opposite edges of the ladder side rail (16) (FIGS. 5, 7).

The first and second ladder side rail engaging portions (34, 36) of the first arm (26) are preferably comprised of "U" shaped channel members (42) (FIGS. 5, 7) having a web portion (44) (FIG. 5) of a sufficient width to receive the edge of the ladder side rail (16). The leg portions (46, 47) (FIG. 5) of the U-shaped channel members (42) extend inward toward the ladder side rail (16) on each side thereof to keep the edges of the ladder side rails (16) within the channel members (42) thereby restricting lateral movement and ensuring that the device (20) will not slip off the edge of the side rail (16). Adjacent corners of the outside leg (46) of the U-shaped channel member (42) are preferably clipped and curved (see FIG. 7) to facilitate removal and attachment of the device (20) from/onto the ladder side rail (16) (discussed later). The inside face of the web portion (44) preferably includes roughed grips (48) (FIGS. 5, 7) having transverse ridges thereon to assist in gripping the edge of the ladder side rail (16). These roughened grips (48) are preferably removably attached, such as by set screws (50), to the web (44) of the channel members (42).

The first and second ladder side rail engaging portions (38, 40) of the second arm (28) are preferably comprised of rollers (52) (FIGS. 5, 7), which are rotatably attached to the second arm (28) by a pin connection (54). Flanges (56, 58) (FIG. 5) on the rollers (52) keep the rollers (52) on the ladder side rails (16) thereby restricting lateral movement and ensuring that the device (20) will not slip off the edge of the side rail (16). A bushing or spacer (60) (FIG. 5) positions the rollers (52) laterally outward of the second arm (28) such that the rollers (52) are vertically aligned with the channel members (42) of the first arm (26) (best viewed in FIG. 5).

An arm locking mechanism (62) (FIGS. 3, 5, 6) is attached to the second arm (28). The arm locking mechanism (62) includes a pin (64) (FIG. 5) having a first narrow diametered end (66) and a second larger diametered end (72) thereby creating a shoulder (73). The first end (66) of the pin (64) projects through an open end of the housing (68) (FIG. 5) and through an aperture (70) in the second arm (28). Near the second larger diametered end (72) of the pin (64) is a pin handle (74) which extends though slots (76) in the housing (68). A spring (78) within the housing (68) biases the pin (64) outward, such that the first end (66) of the pin (64) is normally extending through the open end of the housing (68) and through the aperture (70) in the second arm (28). The pin shoulder (73) retains the spring biased pin (64) within the housing (68). The first end (66) of the projecting pin (64) acts to interfere with the first arm (26) by abutting against the upper edge of the first arm (26) to restrict its upward pivotal movement so that the first arm (26) may not be pivoted beyond the climbing position (the climbing position is shown in dashed lines in FIGS. 6 and 7—discussed in detail later under the operation of the device). The first arm (26) preferably includes a groove (80) (FIGS. 5, 6, 7) in its upper edge for receiving the first end (66) of the projecting pin (64) in abutting engagement therewith.

In addition to restricting the movement of the device (20) between a fall arresting position and a climbing position (discussed later under the operation of the device), the arm locking mechanism (62) may lock the arms (26, 28) of the device (20) into the disengaging position (FIG. 8) (also discussed later under the operation of the device), wherein the first and second arms (26, 28) are pivoted outwardly and locked in a position such that the ladder side rail engaging portions (34, 36, 38, 40) will not engage the edges of the ladder side rail (16). With the arms (26, 28) locked in the disengaging position, the device (20) can then be quickly removed or attached to the ladder side rail (16) as needed. Referring to FIG. 5 in conjunction with FIG. 8, to lock the device (20) into the disengaging position, the pin handle (74) is pulled back, thereby compressing the spring (78) and drawing the pin (64) a sufficient distance into the housing (68) to enable the handle portion (32) of the first arm (26) to pivot upward until the first end (66) of the pin (64) is received by the indentation (82) (FIG. 6) in the face of the first arm (26). Releasing the pin handle (74), such that the first end (66) of the pin (64) is received in the indentation (82), locks the device (20) in the disengaging position. The device (20) will remain in the disengaging position until the pin handle (74) is again pulled pack to remove the pin (64) from the indentation (82) thereby allowing the handle portion (32) of the first arm (26) to pivot downwardly to return the device (20) to its normal fall arresting position (shown in dashed lines in FIG. 8).

Operation of the Device

Figure 8:
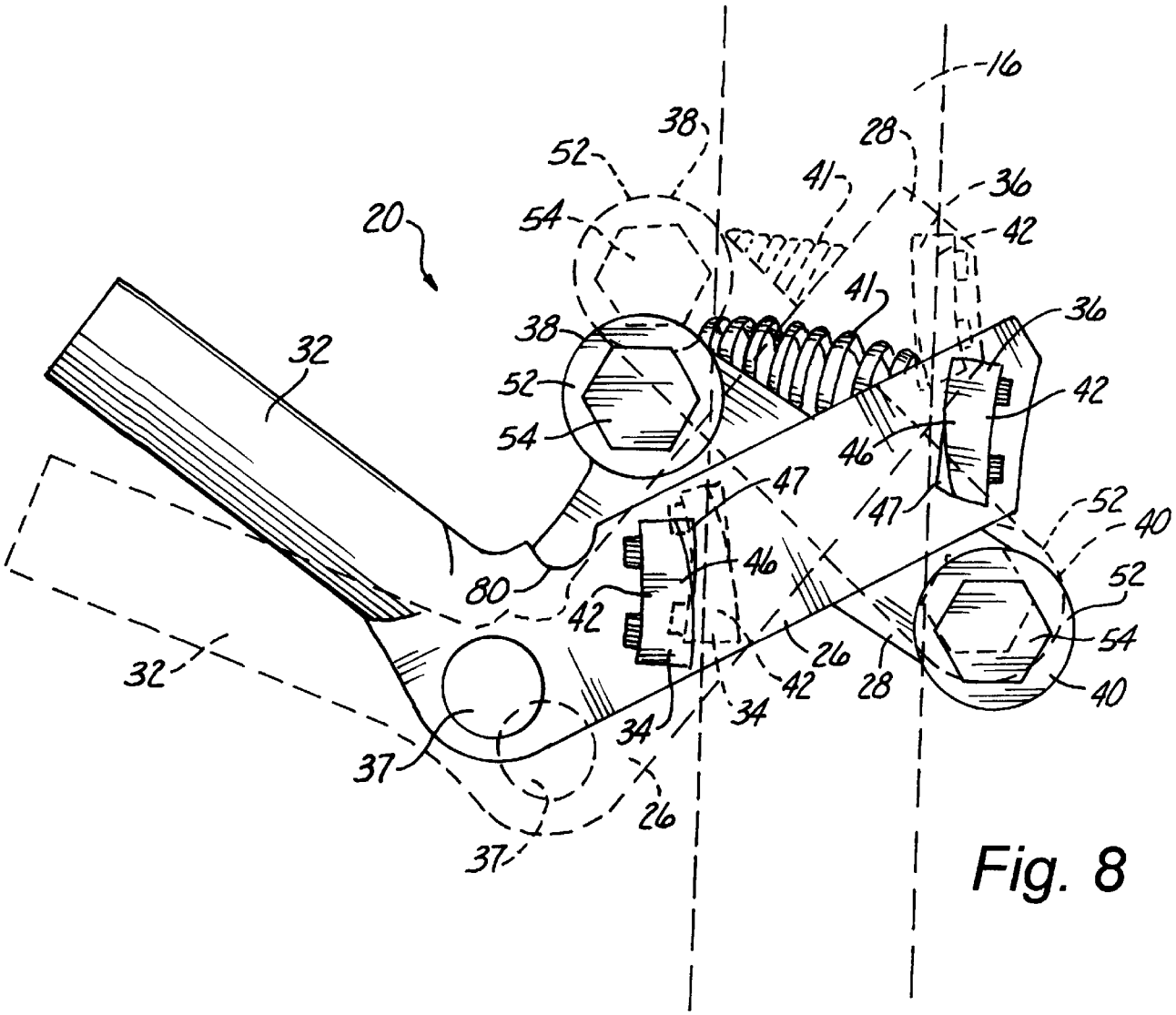
FIG. 8 is a right side elevation view showing the movement of the arms between the fall arresting position (dashed lines) and the disengaged position (solid lines).

In operation, the first step is to attach the fall arresting device (20) to the ladder side rail (16). It should be appreciated that the attached drawing figures show the device (20) mounted on the left side rail (16). If it is desired to attach the device to the right ladder side rail (16), one need only produce a mirror image of the device (20) shown in FIGS. 1–8. Attaching the device (20) to the ladder (14) is accomplished by first locking the device (20) into its disengaging position as shown in FIG. 8 and as described immediately above. The device (20) is then placed over the ladder side rail (16). The edges of the ladder side rail (16) are aligned with the U-shaped channels (42) and rollers (52) (see FIG. 5) of the ladder side rail engaging portions (34, 36, 38, 40) of the first and second arms (26, 28). The pin (64) is then released from the indentation (82) (FIG. 6) which allows the handle portion (32) of the first arm (26) to pivot downwardly until the device (20) is in its normal fall arresting position (dashed lines in FIG. 8, solid lines in FIGS. 6 and 7). As mentioned previously, in the normal fall arresting position, the U-shaped channel members (42) and the rollers (52) (FIGS. 4–7) of the side rail engaging members (34, 36, 38, 40) are securely engaged on the edges of the ladder side rail (16) due to the bias of the coil spring (41) pulling the pivotal crossing arms (26, 28) toward each other such that they close or clamp onto the ladder side rail (16) therebetween. It should therefore be appreciated, that once the device (20) is properly attached to the ladder side rail (16), the device (20) is normally locked or clamped onto the ladder side rail (16) in the fall arresting position, such that it will not move up or down the ladder side rail (16) until the first arm (26) is pivoted upward to the climbing position (described below and shown in dashed lines in FIGS. 5 and 6). Thus, if the climber (12) is wearing a body harness (22) (FIGS. 1, 2) with a lanyard (24) attached at one end thereto and connected to the device (20) at the other end, the climber will only free fall the length of the lanyard (24) before his fall is arrested by the device (20) as shown in FIG. 2.

When ascending or descending the ladder (14), the climber (12) grasps the handle portion (32) of the first arm (26) with one hand (see FIG. 1), and grasps a ladder rung (18), or the opposite ladder side rail (16), with the other hand. Thus, instead of grasping the ladder (14) with both hands, as one normally would when climbing a ladder, with the device of the present invention, only one hand grasps the ladder, while the other hand remains on the handle (32) of the fall arresting device (20). To begin climbing, the handle (32) is pivoted upwardly with sufficient force to overcoming the bias of the coil spring (41) until it abuts the pin (64) (FIG. 7), thus pivoting the arms (26, 28) from the normal fall arresting position (solid lines), to the climbing position (dashed lines). In the climbing position, the roughened grips (48) of the U-shaped channels (42) of the rail engaging members (34, 36) of the first arm (26) are disengaged from the ladder side rail (16), leaving only the rollers (52) of the second arm (28) engaging the edges of the ladder side rail (16). Thus, in the climbing position, the device (20) is free to roll along the ladder side rail (16) as the climber (12) pushes the device upward by extending his or her arm. It should be appreciated however, that in the climbing position, even though the roughened grips (48) are disengaged from the edges of the ladder side rail (16), the side rail edges are still within the inwardly projecting legs (46, 47) of the U-shaped channel members (42) thereby preventing the device (20) from canting and slipping off the edges of the ladder side rail (16). When the climber's arm reaches the desired amount of extension, the upward force exerted on the handle (32) is released. The bias of the coil spring (41) returns the pivoting arms (26, 28) to their normal fall arresting position in which both the rollers (52) and the roughened grips (48) are engaging the ladder side rail (16). Keeping one hand on the handle (32), and using it and the other hand to pull up while stepping on the next rung (18), the climber continues up the ladder (14) by repeating the process. When the top of the ladder (14) is reached, the climber simply steps off the ladder (14) onto the landing surface. The fall arresting device (20) can then be removed from the ladder side rail (16) by locking the arms (26, 28) in the disengaging position (solid lines in FIG. 8) as described above. The device (20) can be carried by the climber until the climber must descend the ladder (14). In which event, the same procedure is followed, except that instead of rolling the device (20) up the ladder side rail (16), the device (20) is rolled down the ladder side rail (16).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A fail arresting device in combination with a ladder having a side rail and rungs, said ladder side rail having a front edge and an opposing back edge, said fall arresting device, comprising:

(a) a first arm having first and second ladder side rail engaging portions;

(b) a second arm pivotally connected to said first arm and having first and second ladder side rail engaging portions;

(c) a spring operably attached to said first and second arms for biasing said first and second arms between a first fall arresting position and a second climbing position, said spring normally biasing said arms in said first fall arresting position wherein said first and second ladder side rail engaging portions of both first and second arms are engaging the ladder side rail wherein said first and arms are pivotally connected in crossing relation such that when said fall arresting device is mounted on the ladder side rail, said first and second ladder side rail engaging portions of each of said first and second arms are disposed on the opposite front and back edges of the ladder side rail and (d) a handle fixed to one of said arms and extending outwardly therefrom wherein said handle is dimensioned to be grasped by a hand of a user while ascending and descending the ladder and manipulated to move said first and second arms between said first fall arresting position and said second climbing position.

2. The fall arresting device of claim 1 further comprising an aperture disposed in one of said arms for removably attaching a lanyard thereto.

3. The fall arresting device of claim 1 wherein said first and second ladder side rail engaging portions of said first arm include roughed grips for gripping engagement with the ladder side rail.

4. The fall arresting device of claim 3 wherein said first and second ladder side rail engaging portions of said second arm include rollers for rolling engagement with the ladder side rail.

5. The fall arresting device of claim 1 further comprising an arm locking mechanism which locks said first and second arms in a third disengaged position such that said fall arresting device is removable from the ladder side rail.

6. A fall arresting device in combination with a ladder having a side rail and rungs, said ladder side rail having a front edge and an opposing back edge, said fall arresting device, comprising:

(a) a first arm having first and second ladder side rail engaging portions;

(b) a second arm pivotally connected to said first arm and having first and second ladder side rail engaging portions;

(c) biasing means for biasing said first and second arms between a first fall arresting position and a second climbing position, said biasing means normally biasing said arms in said first fall arresting position wherein said first and second ladder side rail engaging portions of both first and second arms are engaging the ladder side rail wherein said first and second arms are pivotally connected in crossing relation such that when said fall arresting device is mounted on the ladder side rail, said first and second ladder side rail engaging portions of each of said first and second arms are disposed on the opposite front and back edges of the ladder side rail; and, (d) handle means dimensioned to be grasped by a hand of a user while ascending and descending the ladder and for moving said first and second arms between said first fall arresting position and said second climbing position.

7. The fall arresting device of claim 6 further comprising an aperture disposed in one of said arms for removably attaching a lanyard thereto.

8. The fall arresting device of claim 6 wherein said first and second ladder side rail engaging portions of said first arm include roughed grips for gripping engagement with the ladder side rail.

9. The fall arresting device of claim 8 wherein said first and second ladder side rail engaging portions of said second arm include rollers for rolling engagement with the ladder side rail.

10. The fall arresting device of claim 6 further comprising an arm locking mechanism which locks said first and second arms in a third disengaged position such that said fall arresting device is removable from the ladder side rail.

11. A ladder safety system, comprising:

(a) a fall arresting device in combination with a ladder having side rail and rungs, said ladder side rail having a front edge and an opposing back edge, said fall arresting device, comprising:

(i) a first arm having first and second ladder side rail engaging portions;

(ii) a second arm pivotally connected to said first arm and having first and second ladder side rail engaging portions wherein said first and second arms are pivotally connected in crossing relation such that when said fall arresting device is mounted on the ladder side rail, said first and second ladder side rail engaging portions of each of said first and second arms are disposed on the opposing front and back edges of the ladder side rail;

(iii) a spring operably attached to said first and second arms for biasing said first and second arms between a first fall arresting position and a second climbing position, said spring normally biasing said arms in said first fall arresting position wherein said first and second ladder side rail engaging portions of both first and second arms are engaging the ladder side rail; and, (iv) a handle fixed to one of said arms and extending outwardly therefrom a distance dimensioned to be grasped by a man's hand, wherein said handle is manipulated while ascending and descending the ladder to move said first and second arms between said first fall arresting position and said second climbing position;

(b) a body harness to be worn by a climber; and (c) a lanyard removably connectable at one end to said fall arresting device and removably connectable at another end to said body harness.

12. The ladder safety system of claim 11 wherein said first and second ladder side rail engaging portions of said first arm of said fall arresting device include roughed grips for gripping engagement with the ladder side rail.

13. The ladder safety system of claim 12 wherein said first and second ladder side rail engaging portions of said second arm of said fall arresting device include rollers for rolling engagement with the ladder side rail.

14. The ladder safety system of claim 11 wherein said fall arresting device includes an arm locking mechanism which locks said first and second arms in a third disengaged position such that said fall arresting device is removable from the ladder side rail.

15. A fall arresting device in combination with a ladder having a side rail and rungs, said ladder side rail having a front edge and an opposing back edge, said fall arresting device, comprising:

(a) a first arm having first and second ladder side rail engaging portions, said first ladder side rail engaging portion disposed on the back edge of the ladder side rail, said second ladder side rail engaging portion disposed on the front edge of the ladder side rail;

(b) a second arm having first and second ladder side rail engaging portions, said first ladder side rail engaging portion disposed on the front edge of the ladder side rail, said second ladder side rail engaging portion disposed on the back edge of the ladder side rail, said first arm pivotally connected to said second arm in crossing relation;

(c) a spring operably attached to said first and second arms for biasing said first and second arms between a first fall arresting position and a second climbing position, said spring normally biasing said arms in said first fall arresting position herein said first and second ladder side rail engaging portions of both first and second arms are engaging the front and back edges of the ladder side rail; and (d) a handle connected to one of said arms whereby said handle is dimensioned to be grasped by one hand of a user while ascending and descending the ladder and manipulated to move said first and second arms between said first fall arresting position and said second climbing position.

16. The fall arresting device of claim 15 further comprising an aperture disposed in one of said arms for removably attaching a lanyard thereto.

17. The fall arresting device of claim 15 wherein said first and second ladder side rail engaging portions of said first arm include roughed grips for gripping engagement with the front edge and back edge of the ladder side rail.

18. The fall arresting device of claim 17 wherein said first and second ladder side rail engaging portions of said second arm include rollers for rolling engagement with the front edge and back edge of the ladder side rail.

19. The fall arresting device of claim 15 further comprising an arm locking mechanism which locks said first and second arms in a third disengaged position such that said fall arresting device is removable from the ladder side rail.

* * * * *